US011195454B2

(12) United States Patent
Chen et al.

(10) Patent No.: US 11,195,454 B2
(45) Date of Patent: Dec. 7, 2021

(54) PIXEL DRIVING CIRCUIT, DRIVING METHOD THEREOF, DISPLAY PANEL AND DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Shuai Chen, Beijing (CN); Xiuzhu Tang, Beijing (CN); Taoliang Tang, Beijing (CN); Shuang Hu, Beijing (CN); Xing Dong, Beijing (CN); Zhenguo Tian, Beijing (CN); Meiling Tan, Beijing (CN); Huan Wang, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/255,682

(22) PCT Filed: Apr. 7, 2020

(86) PCT No.: PCT/CN2020/083548
§ 371 (c)(1),
(2) Date: Dec. 23, 2020

(87) PCT Pub. No.: WO2020/211686
PCT Pub. Date: Oct. 22, 2020

(65) Prior Publication Data

US 2021/0272513 A1 Sep. 2, 2021

(30) Foreign Application Priority Data

Apr. 18, 2019 (CN) ..... 201910312247.X

(51) Int. Cl.
*G09G 3/32* (2016.01)
*G09G 3/20* (2006.01)

(52) U.S. Cl.
CPC ..... *G09G 3/32* (2013.01); *G09G 3/2092* (2013.01); *G09G 2310/0278* (2013.01); *G09G 2330/023* (2013.01)

(58) Field of Classification Search
None
See application file for complete search history.

(56) References Cited

U.S. PATENT DOCUMENTS 8,963,907 B2 2/2015 Tsai et al.
9,589,505 B2 3/2017 Zhang
(Continued)

FOREIGN PATENT DOCUMENTS

CN 102436793 A 5/2012
CN 103150992 A 6/2013
(Continued)

OTHER PUBLICATIONS

First Chinese Office Action dated May 8, 2020, for corresponding Chinese Application No. 201910312247.X.

*Primary Examiner* — Chad M Dicke
(74) *Attorney, Agent, or Firm* — Kinney & Lange, P.A.

(57) ABSTRACT

The present disclosure provides a pixel driving circuit and a driving method thereof, a display panel, and a display device. The pixel driving circuit, comprising: a driving current generating circuit having a control terminal, a first terminal, and a second terminal; a data circuit configured to provide a signal from a data signal terminal to the control terminal of the driving current generating circuit in response
(Continued)

to a signal from a first scan signal terminal, and provide a signal from the data signal terminal to the second terminal of the driving current generating circuit in response to a signal from a second scan signal terminal; a voltage circuit configured to provide a signal from a first voltage signal terminal to a first node in response to a signal from a light-emitting control signal terminal; and a control circuit configured to electrically connect the first node and the control terminal of the driving current generating circuit in response to a signal from the second scan signal terminal, and electrically connect the first node and the first terminal of the driving current generating circuit in response to a signal from a third scan signal terminal.

20 Claims, 5 Drawing Sheets

(56) References Cited

U.S. PATENT DOCUMENTS

| | | | | |
|---|---|---|---|---|
| 9,805,654 | B2 * | 10/2017 | Yang | G09G 3/3258 |
| 9,953,569 | B2 | 4/2018 | Mu et al. | |
| 10,347,177 | B2 | 7/2019 | Zhang et al. | |
| 10,396,310 | B2 | 8/2019 | Choi et al. | |
| 10,902,781 | B2 | 1/2021 | Xiao et al. | |
| 2010/0149140 | A1 * | 6/2010 | Nakamura | G09G 3/3233 345/204 |
| 2012/0293479 | A1 * | 11/2012 | Han | G09G 3/3266 345/212 |
| 2013/0127818 | A1 | 5/2013 | Tsai et al. | |
| 2016/0005356 | A1 | 1/2016 | Zhang | |
| 2016/0232836 | A1 * | 8/2016 | Yang | G09G 3/3233 |
| 2017/0018226 | A1 * | 1/2017 | Yang | G09G 3/3233 |
| 2017/0018229 | A1 | 1/2017 | Zhang et al. | |
| 2017/0270859 | A1 * | 9/2017 | Li | G09G 3/3258 |
| 2018/0047343 | A1 * | 2/2018 | Liao | G09G 3/3266 |
| 2018/0357963 | A1 | 12/2018 | Gai et al. | |
| 2020/0027402 | A1 | 1/2020 | Xiao et al. | |

FOREIGN PATENT DOCUMENTS

| | | | |
|---|---|---|---|
| CN | 103531151 | A | 1/2014 |
| CN | 104318897 | A | 1/2015 |
| CN | 104933993 | A | 9/2015 |
| CN | 108665852 | A | 10/2018 |
| CN | 108877669 | A | 11/2018 |
| CN | 109074777 | A | 12/2018 |
| CN | 109584788 | A | 4/2019 |
| CN | 110010071 | A | 7/2019 |
| WO | 2018209930 | A1 | 11/2018 |
| WO | 2020019158 | A1 | 1/2020 |
| WO | 2020151233 | A1 | 7/2020 |

* cited by examiner

PIXEL DRIVING CIRCUIT, DRIVING METHOD THEREOF, DISPLAY PANEL AND DISPLAY DEVICE

CROSS-REFERENCE TO RELATED APPLICATION

This application is a Section 371 National Stage Application of International Application No. PCT/CN2020/083548, filed on Apr. 7, 2020, entitled "PIXEL DRIVING CIRCUIT, DRIVING METHOD THEREOF, DISPLAY PANEL AND DISPLAY DEVICE", which claims priority to Chinese Patent Application No. 201910312247.X, filed on Apr. 18, 2019, which is incorporated herein by reference in its entirety.

TECHNICAL FIELD

The present disclosure relates to a field of display technology, and particularly to a pixel driving circuit and a driving method thereof, a display panel, and a display device.

BACKGROUND

Organic Light-emitting Diode (OLED) displays have the advantages of low energy consumption, low production cost, self-luminescence, wide viewing angle and fast response speed etc., and are one of the hot spots in a field of flat panel display research today. Among them, a design of the pixel driving circuit for controlling the OLED to emit light is a core technical content of the OLED display. Since OLED is driven by current, a stable current is needed to control its light emission. However, due to the process and device aging, a threshold voltage $V_{th}$ of the driving transistor driving the OLED to emit light in the pixel driving circuit will be uneven, which will cause the current flowing through the OLED to change and cause uneven display brightness, thereby affecting a display effect of an entire image.

SUMMARY

Embodiments of the present disclosure provide a pixel driving circuit and a driving method thereof, a display panel, and a display device.

Embodiments of the present disclosure provide a pixel driving circuit, comprising: a driving current generating circuit having a control terminal, a first terminal, and a second terminal; a data circuit configured to provide a signal from a data signal terminal to the control terminal of the driving current generating circuit in response to a signal from a first scan signal terminal, and provide a signal from the data signal terminal to the second terminal of the driving current generating circuit in response to a signal from a second scan signal terminal; a voltage circuit configured to provide a signal from a first voltage signal terminal to a first node in response to a signal from a light-emitting control signal terminal; and a control circuit configured to electrically connect the first node and the control terminal of the driving current generating circuit in response to a signal from the second scan signal terminal, and electrically connect the first node and the first terminal of the driving current generating circuit in response to a signal from a third scan signal terminal.

In some embodiments, the data circuit comprises: a first switch transistor and a second switch transistor; wherein a gate of the first switch transistor is coupled to the first scan signal terminal, a first electrode of the first switch transistor is coupled to the data signal terminal, and a second electrode of the first switch transistor is coupled to the control terminal of the driving current generating circuit; and a gate of the second switch transistor is coupled to the second scan signal terminal, a first electrode of the second switch transistor is coupled to the data signal terminal, and a second electrode of the second switch transistor is coupled to the second terminal of the driving current generating circuit.

In some embodiments, the control circuit comprises: a third switch transistor and a fourth switch transistor; wherein a gate of the third switch transistor is coupled to the second scan signal terminal, a first electrode of the third switch transistor is coupled to the first node, and a second electrode of the third switch transistor is coupled to the control terminal of the driving current generating circuit; and a gate of the fourth switch transistor is coupled to the third scan signal terminal, a first electrode of the fourth switch transistor is coupled to the first node, and a second electrode of the fourth switch transistor is coupled to the first terminal of the driving current generating circuit.

In some embodiments, the voltage circuit comprises: a fifth switch transistor; wherein a gate of the fifth switch transistor is coupled to the light-emitting control signal terminal, a first electrode of the fifth switch transistor is coupled to the first voltage signal terminal, and a second electrode of the fifth switch transistor is coupled to the first node.

In some embodiments, the driving current generating circuit comprises: a driving transistor, wherein a gate of the driving transistor is used as the control terminal of the driving current generating circuit, a first electrode of the driving transistor is used as the first terminal of the driving current generating circuit, and a second electrode of the driving transistor uses as the second terminal of the driving current generating circuit; and a storage capacitor, wherein a first terminal of the storage capacitor is coupled to the gate of the driving transistor, and a second terminal of the storage capacitor is coupled to the second electrode of the driving transistor.

Embodiments of the present disclosure also provide a method for driving the pixel driving circuit described above, comprising that: in a recovery phase, the voltage circuit provides a signal from the first voltage signal terminal to the first node in response to a signal from the light-emitting control signal terminal; the control circuit electrically connects the first node and the control terminal of the driving current generating circuit in response to a signal from the second scan signal terminal; the data circuit provides a signal being at a first preset voltage from the data signal terminal to the second terminal of the driving current generating circuit in response to the signal from the second scan signal terminal; in a voltage adjustment phase, the control circuit electrically disconnects the first node from the control terminal of the driving current generating circuit in response to a signal from the second scan signal terminal, and the data circuit provides a signal being at a second preset voltage from the data signal terminal to the control terminal of the driving current generating circuit in response to a signal from the first scan signal terminal; wherein the first preset voltage is less than the second preset voltage, and the second preset voltage is less than or equal to 0V; in a threshold latch phase, the control circuit electrically connects the first node and the first terminal of the driving current generating circuit in response to a signal from the third scan signal terminal; in a data input phase, the voltage circuit electrically disconnects the first voltage signal terminal from the first node in response to a signal from the light-emitting control signal terminal; the data circuit provides a signal being at a data voltage from the data signal terminal to the control terminal of the driving current generating circuit in response to a signal from the first scan signal terminal; and in a light-emitting phase, the voltage circuit provides a signal from the first voltage signal terminal to the first node in response to a signal from the light-emitting control signal terminal; the data circuit electrically disconnects the data signal terminal from the control terminal of the driving current generating circuit in response to a signal from the first scan signal terminal, and the driving current generating circuit generates a driving current flowing from the first terminal of the driving current generating circuit to the second terminal of the driving current generating circuit.

In some embodiments, in the recovery phase, the voltage circuit provides a signal being at a first preset power supply voltage from the first voltage signal terminal to the first node in response to the signal from the light-emitting control signal terminal; wherein the first preset power supply voltage is not equal to the first preset voltage; and in the voltage adjustment phase, the voltage circuit provides the signal being at the first preset power supply voltage from the first voltage signal terminal to the first node in response to the signal from the light-emitting control signal terminal.

In some embodiments, in the threshold latch phase, the voltage circuit provides a signal being at a second preset power supply voltage from the first voltage signal terminal to the first node in response to the signal from the light-emitting control signal terminal; wherein the second preset power supply voltage is less than the first preset power supply voltage.

In some embodiments, in the light-emitting phase, the voltage circuit provides a signal being at a third preset power supply voltage from the first voltage signal terminal to the first node in response to the signal from the light-emitting control signal terminal; wherein the third preset power supply voltage is greater than the first preset power supply voltage.

In some embodiments, in the voltage adjustment phase, the signal being at the second preset voltage from the data signal terminal is provided to the control terminal of the driving current generating circuit, after the first node is electrically disconnected from the control terminal of the driving current generating circuit.

In some embodiments, in the light-emitting phase, the signal from the first voltage signal terminal is provided to the first node after the data signal terminal is electrically disconnected from the control terminal of the driving current generating circuit.

Embodiments of the present disclosure also provide a display panel comprising the pixel driving circuit described above.

Embodiments of the present disclosure also provide a display device comprising the display panel described above.

DETAILED DESCRIPTION OF EMBODIMENTS

Figure 1:
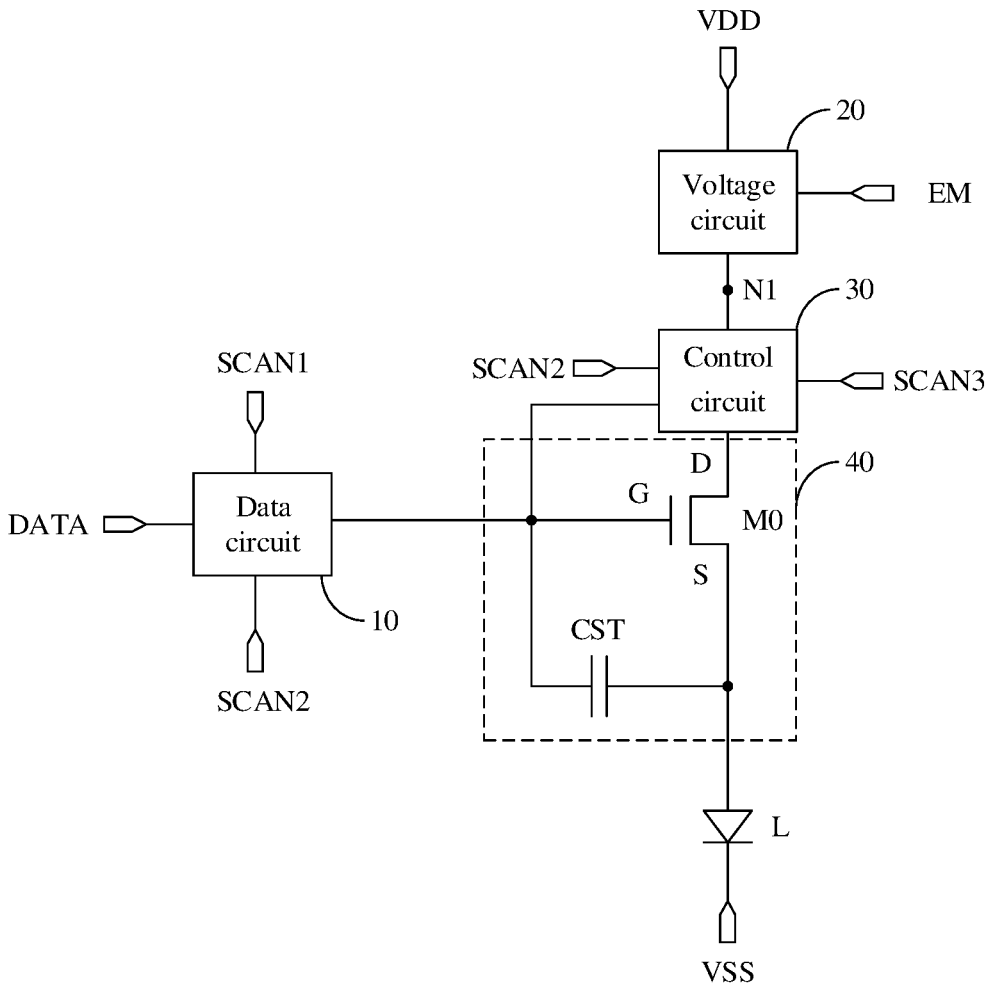
FIG. 1 is a schematic structural diagram of a pixel driving circuit provided by an embodiment of the present disclosure.

In order to make the objectives, technical solutions and advantages of the present disclosure clearer, specific implementations of a pixel driving circuit and a driving method thereof, a display panel, and a display device provided by the embodiments of the present disclosure will be described in detail below with reference to the accompanying drawings. It should be understood that the embodiments described below are only used to illustrate and explain the present disclosure, and are not used to limit the present disclosure. And in a case of no conflict, the embodiments in the present disclosure and the features in the embodiments can be combined with each other. It should be noted that the size and shape of each figure in the drawings do not reflect the true scale, and the purpose is only to illustrate the present disclosure. And the same or similar reference numerals indicate the same or similar elements or elements with the same or similar functions.

According to the pixel driving circuit and the driving method thereof, the display panel, and the display device provided by the embodiments of the present disclosure, a data circuit provides a signal from a data signal terminal to a gate of a driving transistor in response to a signal from a first scan signal terminal, and provides the signal from the data signal terminal to a first terminal of an light-emitting device in response to a signal from a second scan signal terminal; a voltage circuit provides a signal from a first voltage signal terminal to a first node in response to a signal from a light-emitting control signal terminal; and a control circuit couples the first node and the gate of the driving transistor in response to a signal from a second scan signal terminal, and couples the first node and the first electrode of the driving transistor in response to a signal from a third scan signal terminal. In this way, a threshold voltage $V_{th}$ of the driving transistor may be compensated through the cooperation of the above-mentioned circuits, the driving transistor, and a storage capacitor, so that a driving current of the driving transistor to drive the light-emitting device to emit light is independent of the threshold voltage of the driving transistor, and an impact of the threshold voltage of the driving transistor on the driving current flowing through the light-emitting device may be avoided. Therefore the driving current may be kept stable, and a brightness uniformity of a display area of the display device may be improved.

An embodiment of the present disclosure provides a pixel driving circuit, as shown in FIG. 1, including: a data circuit 10, a voltage circuit 20, a control circuit 30, and a driving current generating circuit 40.

The driving current generating circuit 40 has a control terminal, a first terminal, and a second terminal. The driving current generating circuit 40 may include a driving transistor M0 and a storage capacitor CST. A gate G of the driving transistor M0 uses as a control terminal of the driving current generating circuit 40, a first electrode D of the driving transistor M0 uses as a first terminal of the driving current generating circuit 40, and a second electrode S of the driving transistor M0 uses as a second terminal of the driving current generating circuit 40. The second terminal of the driving current generating circuit 40 (for example, the second electrode S of the driving transistor M0) may be coupled to a first terminal of the light-emitting device L, so as to drive the light-emitting device L to emit light. A first terminal of the storage capacitor CST is coupled to the gate G of the driving transistor M0, and a second terminal of the storage capacitor CST is coupled to the second terminal S of the driving transistor M0.

The data circuit 10 is configured to provide a signal from a data signal terminal DATA to the control terminal of the driving current generating circuit 40 (for example, the gate G of the driving transistor M0), in response to a signal from a first scan signal terminal SCAN1, and provide the signal from the data signal terminal DATA to the second terminal of the driving current generating circuit 40, in response to a signal from the second scan signal terminal SCAN2, thereby providing the signal from the data signal terminal DATA to the first terminal of the light-emitting device L.

The voltage circuit 20 is configured to provide a signal from a first voltage signal terminal VDD to a first node N1 in response to a signal from the light-emitting control signal terminal EM.

The control circuit 30 is configured to electrically connect the first node N1 and the control terminal of the driving current generating circuit 40 (for example, the gate G of the driving transistor M0) in response to a signal from the second scan signal terminal SCAN2 (i.e., conduct an electrical path between them), and electrically connect the first node N1 to the first terminal of the driving current generating circuit (for example, the first electrode D of the driving transistor M0) in response to a signal from the third scan signal terminal SCANS.

In the pixel driving circuit provided by the embodiment of the present disclosure, a data circuit provides a signal from a data signal terminal to a gate of a driving transistor in response to a signal from a first scan signal terminal, and provides the signal from the data signal terminal to a first terminal of an light-emitting device in response to a signal from a second scan signal terminal; a voltage circuit provides a signal from a first voltage signal terminal to a first node in response to a signal from a light-emitting control signal terminal; and a control circuit couples the first node and the gate of the driving transistor in response to a signal from a second scan signal terminal, and couples the first node and the first electrode of the driving transistor in response to a signal from a third scan signal terminal. In this way, a threshold voltage $V_{th}$ of the driving transistor may be compensated through the cooperation of the above-mentioned circuits, the driving transistor, and a storage capacitor, so that a driving current of the driving transistor to drive the light-emitting device to emit light is independent of the threshold voltage of the driving transistor, and an impact of the threshold voltage of the driving transistor on the driving current flowing through the light-emitting device may be avoided. Therefore the driving current may be kept stable, and a brightness uniformity of a display area of the display device may be improved.

According to an embodiment of the present disclosure, as shown in FIG. 1, the driving transistor M0 may be an N-type transistor; where the first electrode D of the driving transistor M0 is a drain of the driving transistor M0, and the second electrode S of the driving transistor M0 is a source of the driving transistor M0, and when the driving transistor M0 is in a saturated state, current flows from the drain of the driving transistor M0 to the source of the driving transistor M0. Of course, the drive transistor may also be a P-type transistor; where the first electrode of the drive transistor is a source of the driving transistor M0, the second electrode of the driving transistor is a drain of the driving transistor M0, and when the driving transistor is in a saturated state, current flows from the source of the driving transistor to the drain of the driving transistor M0. Of course, in actual applications, the specific type of the driving transistor M0 may be designed and determined according to the actual application environment, which is not limited here.

According to an embodiment of the present disclosure, a second terminal of the light-emitting device L is coupled to a second voltage signal terminal VSS. The first terminal of the light-emitting device is an anode of the light-emitting device, and the second terminal is a cathode of the light-emitting device. In addition, the light-emitting device L may include: OLED or Quantum Dot Light-emitting Diodes (QLED), which realizes light emission under the action of the driving current when the driving transistor is in a saturated state. In addition, a general light-emitting device has a light-emitting threshold voltage $V_{th-L}$, and emits light when the voltage across the light-emitting device is greater than or equal to the light-emitting threshold voltage.

According to an embodiment of the present disclosure, a voltage Vss of the second voltage signal terminal VSS is generally a ground voltage or a negative voltage. In actual applications, the above-mentioned voltage needs to be designed and determined according to the actual application environment, which is not limited here.

The disclosure will be described in detail below in conjunction with specific embodiments. It should be noted that this embodiment is to better explain the present disclosure, but does not limit the present disclosure.

Figure 2:
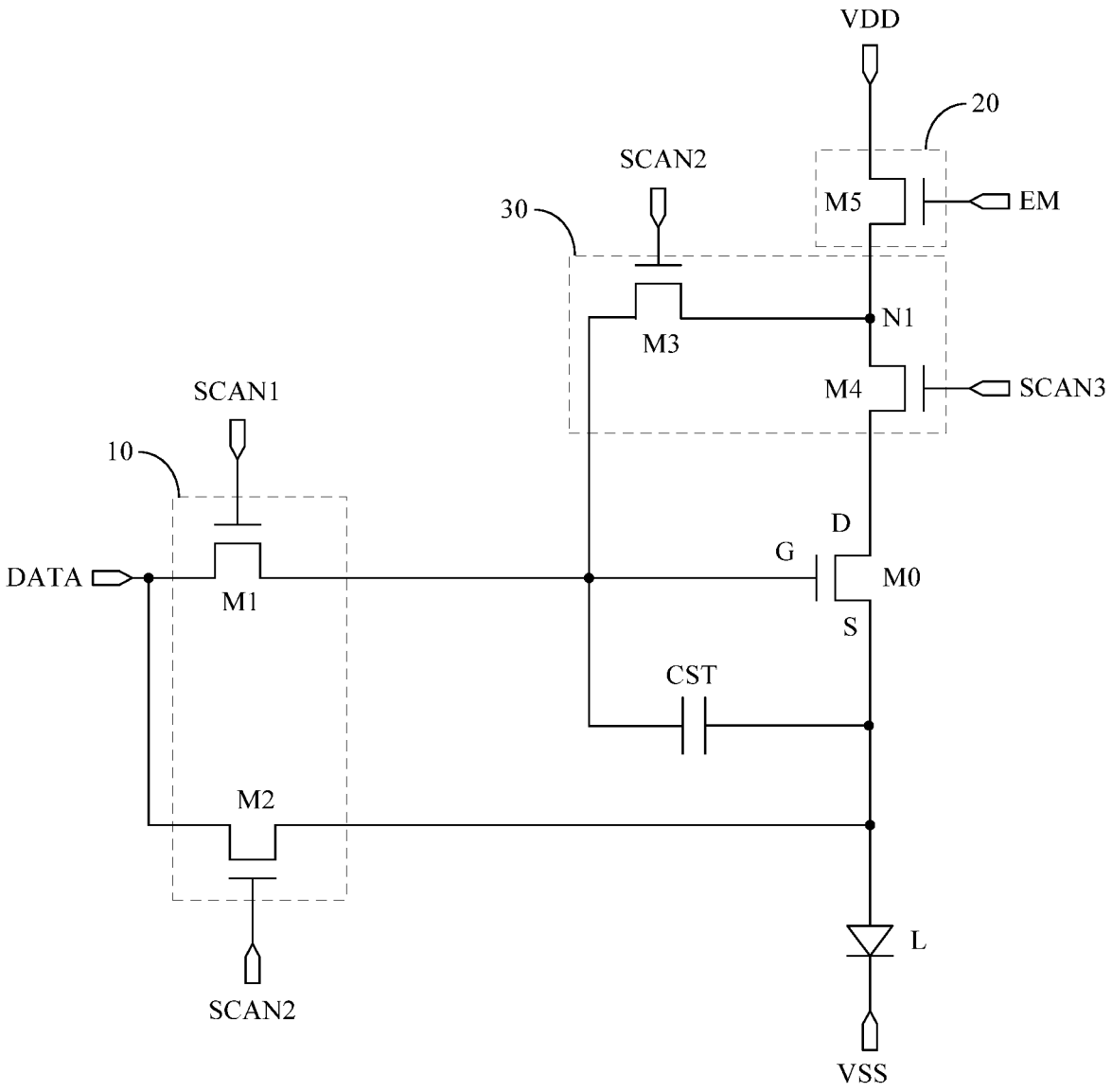
FIG. 2 is a schematic diagram of a specific structure of a pixel driving circuit provided by an embodiment of the present disclosure.

According to the embodiment of the present disclosure, as shown in FIG. 2, the data circuit 10 may include: a first switch transistor M1 and a second switch transistor M2.

A gate of the first switch transistor M1 is coupled to the first scan signal terminal SCAN1, a first electrode of the first switch transistor M1 is coupled to the data signal terminal DATA, and a second electrode of the first switch transistor M1 is coupled to the gate G of the driving transistor M0.

A gate of the second switch transistor M2 is coupled to the second scan signal terminal SCAN2, a first electrode of the second switch transistor M2 is coupled to the data signal terminal DATA, and a second electrode of the second switch transistor M2 is coupled to the first terminal of the light-emitting device L.

According to an embodiment of the present disclosure, the first switch transistor M1 and the second switch transistor M2 may be N-type transistors. Alternatively, the first switch transistor M1 and the second switch transistor M2 may also be P-type transistors, which is not limited here.

According to an embodiment of the present disclosure, when the first switch transistor M1 is in an on state under control of the signal from the first scan signal terminal SCAN1, the signal from the data signal terminal DATA may be provided to the gate G of the driving transistor M0. When the second switch transistor M2 is in an on state under control of the signal from the second scan signal terminal SCAN2, the signal from the data signal terminal DATA may be provided to the first terminal of the light-emitting device L.

According to an embodiment of the present disclosure, as shown in FIG. 2, the control circuit 30 may include: a third switch transistor M3 and a fourth switch transistor M4.

A gate of the third switch transistor M3 is coupled to the second scan signal terminal SCAN2, a first electrode of the third switch transistor M3 is coupled to the first node N1, and a second electrode of the third switch transistor M3 is coupled to the gate G of the driving transistor M0.

A gate of the fourth switch transistor M4 is coupled to the third scan signal terminal SCAN3, a first electrode of the fourth switch transistor M4 is coupled to the first node N1, and a second electrode of the fourth switch transistor M4 is coupled to the first electrode D of the driving transistor M0.

According to an embodiment of the present disclosure, the third switch transistor M3 and the fourth switch transistor M4 may be N-type transistors. Alternatively, the third switch transistor M3 and the fourth switch transistor M4 may also be P-type transistors, which is not limited here.

According to an embodiment of the present disclosure, when the third switch transistor M3 is in an on state under control of the signal from the second scan signal terminal SCAN2, the first node N1 may be electrically connected to (conducted with) the gate G of the driving transistor M0. When the fourth switch transistor M4 is in an on state under control of the signal from the third scan signal terminal SCAN3, the first node N1 may be electrically connected to (conducted with) the first electrode D of the driving transistor M0.

According to an embodiment of the present disclosure, as shown in FIG. 2, the voltage circuit 20 may include: a fifth switch transistor M5.

A gate of the fifth switch transistor M5 is coupled to the light-emitting control signal terminal EM, a first electrode of the fifth switch transistor M5 is coupled to the first voltage signal terminal VDD, and a second electrode of the fifth switch transistor M5 is coupled to the first node N.

According to an embodiment of the present disclosure, the fifth switch transistor M5 may be an N-type transistor. Alternatively, the fifth switch transistor M5 may also be a P-type transistor, which is not limited here.

According to an embodiment of the present disclosure, when the fifth switch transistor M5 is in an on state under control of the signal from the light-emitting control signal terminal EM, the signal from the first voltage signal terminal VDD may be provided to the first node N1.

According to an embodiment of the present disclosure, the storage capacitor CST may store a voltage input to the first terminal of the storage capacitor CST and the second terminal of the storage capacitor CST.

The foregoing is only an example to illustrate the specific structure of each circuit in the pixel driving circuit provided by an embodiment of the present disclosure. In specific implementation, the specific structure of the foregoing circuit is not limited to the foregoing structure provided by an embodiment of the present disclosure, and may also be other structures known to those skilled in the art, which is not limited here.

Further, in order to simplify the manufacturing process of the pixel driving circuit, According to the above pixel driving circuit provided by an embodiment of the present disclosure, as shown in FIG. 2, when the driving transistor M0 is an N-type transistor, all other transistors may be N-type transistors. Of course, when the driving transistor M0 is a P-type transistor, all other transistors may be P-type transistors.

According to the above-mentioned pixel driving circuit provided by an embodiment of the present disclosure, the N-type transistor is turned on under an action of a high level, and turned off under an action of a low level. The P-type transistor is turned off under an action of a high level, and turned on under an action of a low level.

It should be noted that, in the above-mentioned pixel driving circuit provided by an embodiment of the present disclosure, the driving transistor and the switch transistor may be a thin film transistor (TFT), or a metal oxide semiconductor field effect transistor (MOS), not limited here. In specific implementation, depending on different types of the switch transistors and signals from signal terminals, the first electrode of the switch transistor may be used as a source of the switch transistor, and the second electrode of the switch transistor may be used as a drain of the switch transistor; or the first electrode of the switch transistor may be used as a drain of the switch transistor, and the second electrode of the switch transistor may be used as a source of the switch transistor, and no specific distinction is made here.

Hereinafter, taking the pixel driving circuit shown in FIG. 2 as an example, an operating process of the above-mentioned pixel driving circuit provided by an embodiment of the present disclosure will be described in conjunction with a circuit timing diagram. In the following description, 1 indicates a high level and 0 indicates a low level. It should be noted that 1 and 0 are logic levels, which are only used to better explain the specific operating process of an embodiment of the present disclosure, rather than the voltage applied to the gate of each switch transistor during specific implementation.

First Embodiment

Figure 3:
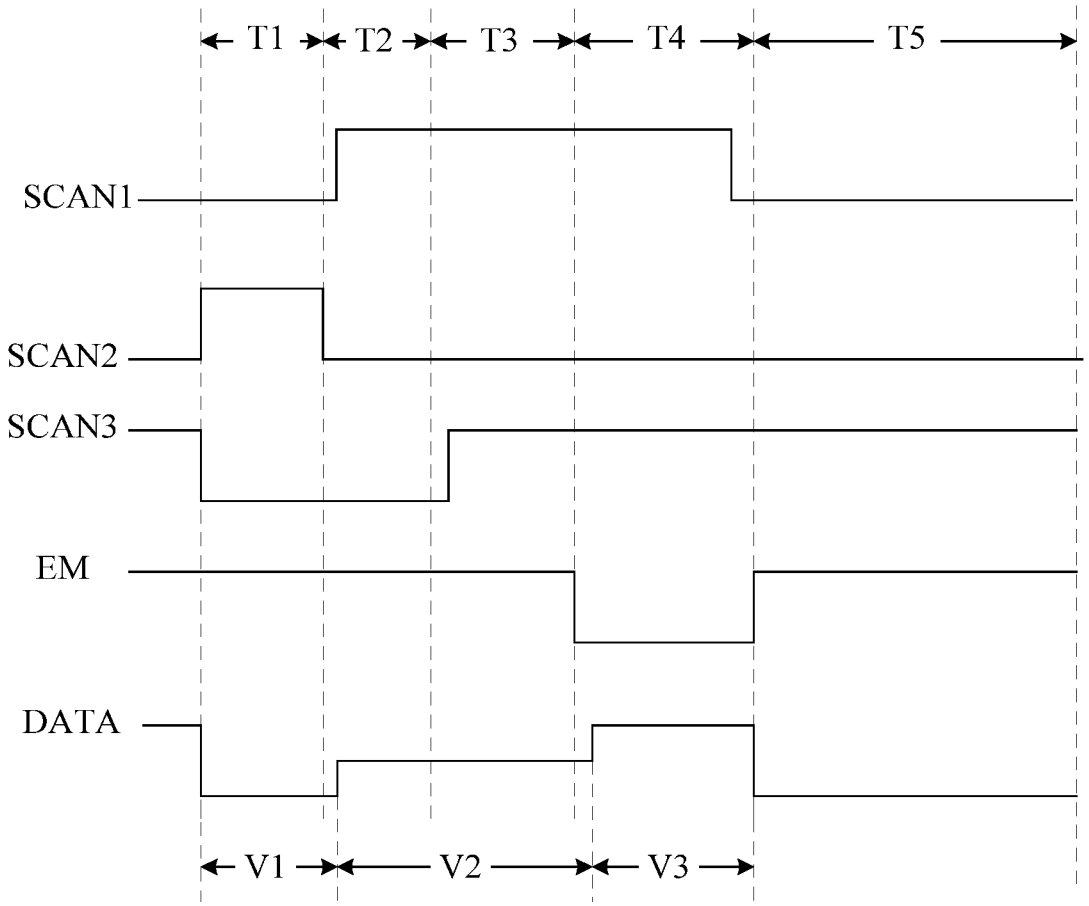
FIG. 3 is a circuit timing diagram provided by an embodiment of the present disclosure.

A circuit timing diagram corresponding to the pixel driving circuit shown in FIG. 2 is shown in FIG. 3. Specifically, five phases of a recovery phase T1, a voltage adjustment phase T2, a threshold latch phase T3, a data input phase T4, and a light-emitting phase T5 in the input timing diagram shown in FIG. 3 are selected.

In the recovery phase T1, SCAN1=0, SCAN2=1, SCAN3=0, EM=1.

Since SCAN1=0, the first switch transistor M1 is turned off. Since SCAN3=0, the fourth switch transistor M4 is turned off. Since SCAN2=1, the second switch transistor M2 and the third switch transistor M3 are both turned on. Since EM=1, the fifth switch transistor M5 is turned on. The turned-on fifth switch transistor M5 and the turned-on third switch transistor M3 provide the voltage $V_{dd}$ of the signal from the first voltage signal terminal VDD to the gate G of the driving transistor M0, so that the voltage of the gate G of the driving transistor M0 is $V_{dd}$. The turned-on second switch transistor M2 provides a signal being at a first preset voltage V1 from the data signal terminal DATA to the first terminal (anode) of the light-emitting device L. In addition, by making the first preset voltage V1 smaller than $V_{ss}$, the second terminal (cathode) voltage of the light-emitting device L is higher than the anode voltage, so that the light-emitting device L is in a polarity inversion state, thereby restoring the characteristics of the light-emitting device L.

In the voltage adjustment phase T2, SCAN1=1, SCAN2=0, SCAN3=0, EM=1.

Since SCAN2=0, both the second switch transistor M2 and the third switch transistor M3 are turned off. Since SCAN3=0, the fourth switch transistor M4 is turned off. Since SCAN1=1, the first switch transistor M1 is turned on to provide a signal being at a second preset voltage V2 from the data signal terminal DATA to the gate of the driving transistor M0. According to a coupling effect of the storage capacitor CST, a voltage VB at the second terminal of the storage capacitor CST becomes:

$$VB = V1 - (Vdd - V2)\frac{Cs}{Cs + CL},$$

where Cs indicates a capacitance value of the storage capacitor CST, and CL indicates a capacitance value of the light-emitting device L. In the voltage adjustment phase T2, after the second switch transistor M2 and the third switch transistor M3 are turned off, the signal being at the second preset voltage V2 from the data signal terminal DATA is provided to the gate of the driving transistor M0, as shown in FIG. 3. This is achieved by making the transition of VSCAN1 occur after the transition of VSCAN2. This may prevent competition and risk and improve the stability of the pixel driving circuit.

In the threshold latch phase T3, SCAN1=1, SCAN2=0, SCAN3=1, EM=1.

Since SCAN2=0, both the second switch transistor M2 and the third switch transistor M3 are turned off. Since SCAN1=1, the first switch transistor M1 is turned on to provide the signal being at the second preset voltage V2 from the data signal terminal DATA to the gate of the driving transistor M0. Since SCAN3=1, the fourth switch transistor M4 is turned on. Since EM=1, the fifth switch transistor M5 is turned on. The turned-on fifth switch transistor M5 and the turned-on fourth switch transistor M4 provide the voltage $V_{dd}$ of the signal from the first voltage signal terminal VDD to the first electrode of the driving transistor M0. In this way, the anode of the light-emitting device L is charged through the driving transistor M0, the fifth switch transistor M5, and the fourth switch transistor M4, and when the anode of the light-emitting device L is charged to V2-$V_t$h, the driving transistor M0 is turned off. It should be noted that, in order to latch the threshold voltage $V_{th}$ of the driving transistor M0, the following conditions may be satisfied:

$$\left|V2-\left[V1-(Vdd-V2)\frac{Cs}{Cs+CL}\right]\right|>|V_{th}|$$

In the data input phase T4, SCAN1=1, SCAN2=0, SCAN3=1, EM=0.

Since SCAN2=0, both the second switch transistor M2 and the third switch transistor M3 are turned off. Since EM=0, the fifth switch transistor M5 is turned off. Since SCAN1=1, the first switch transistor M1 is turned on to provide a data voltage V3 of the signal from the data signal terminal DATA to the gate of the driving transistor M0. According to the coupling effect of the storage capacitor CST, the voltage VB at the second terminal of the storage capacitor CST becomes:

$$VB=(V2-V_{th})+(V3-V2)\frac{Cs}{Cs+CL}.$$

In addition, in order to avoid unnecessary light emission of the light-emitting device L during the entire display frame period, the voltage VB at the second terminal of the storage capacitor CST may satisfy the formula: VB-$V_{ss}$<$V_{th\text{-}L}$, where $V_{th\text{-}L}$ is a lowest voltage for enabling the light-emitting device L to emit light (also called the threshold voltage of the light-emitting device L).

In the light-emitting phase T5, SCAN1=0, SCAN2=0, SCAN3=1, EM=1.

Since SCAN1=0, the first switch transistor M1 is turned off. Since SCAN2=0, both the second switch transistor M2 and the third switch transistor M3 are turned off. Since EM=1, the fifth switch transistor M5 is turned on. Since SCAN3=1, the fourth switch transistor M4 is turned on. The turned-on fifth switch transistor M5 and the turned-on fourth switch transistor M4 provide the voltage $V_{dd}$ of the signal from the first voltage signal terminal VDD to the first electrode D of the driving transistor M0. According to the saturation state current characteristics, the driving current $I_L$ generated by the driving transistor M0 for driving the light-emitting device L to emit light satisfies the formula:

$$I_L=\beta(V_{gs}-V_{th})^2=\beta\left[(V3-V2)\frac{CL}{Cs+CL}\right]^2,$$

$$\beta=\frac{1}{2}\mu_n C_{ox}\frac{W}{L},$$

$\mu_n$ indicates a mobility of the driving transistor M0, $C_{ox}$ indicates a gate oxide capacitance per unit area, and $$\frac{W}{L}$$

indicates a width-length ratio of the driving transistor M0, these values are relatively stable and may be regarded as constants in same structure, $V_{gs}$ indicates a gate-source voltage of the driving transistor M0.

According to the formula satisfied by the driving current $I_L$, when the driving transistor M0 is in a saturated state, the driving current $I_L$ is related to the second preset voltage V2 and the data voltage V3 at the data signal terminal DATA, and is not related to the threshold voltage $V_{th}$ of the driving transistor M0 and the voltage $V_{dd}$ at the first voltage signal terminal VDD, which may avoid the impact of the drift of the threshold voltage $V_{th}$ of the driving transistor M0 and IR Drop on the driving current, so that the driving current $I_L$ of the light-emitting device L remains stable, thereby ensuring the normal operation of the light-emitting device L.

It should be noted that in a process from the data input phase T4 to the light-emitting phase T5, a time when the signal from the first scan signal terminal SCAN1 transitions from a high level to a low level may be earlier than a time when the signal from the light-emitting control signal terminal EM transitions from a low level to a high level (for example, the preset time earlier), so that after the electrical connection between the data signal terminal DATA and the gate of the driving transistor M0 is uncoupled, the voltage at the first voltage terminal VDD is provided to the first node N1. This may prevent competition and risk and improve the stability of the pixel driving circuit. This process may be regarded as occurring in the transition period from the data input phase T4 to the light-emitting phase T5, of course, it may also be regarded as the end period of the input phase T4, or as the start period of the light-emitting phase T5.

It should be noted that, in the first embodiment of the present disclosure, the voltage $V_{dd}$ of the signal from the first voltage signal terminal VDD may be a constant voltage. Of course, in actual applications, the specific value of $V_{dd}$ may be designed and determined according to the actual application environment, which is not limited here.

It should be noted that the first preset voltage V1 may be less than the second preset voltage V2, and the second preset voltage V2 may be less than or equal to 0V. In actual applications, the specific values of the first preset voltage V1 and the second preset voltage V2 may be designed and determined according to the actual application environment, which is not limited here.

Second Embodiment

Figure 4:
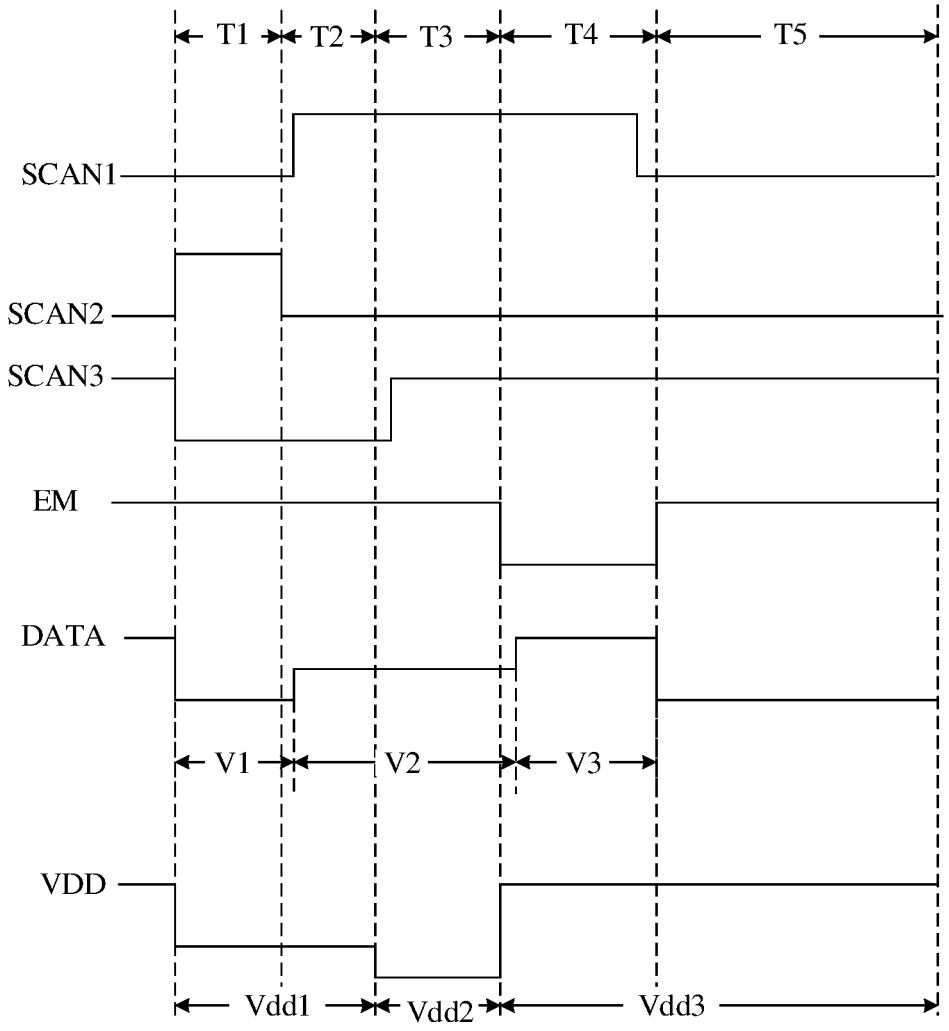
FIG. 4 is another circuit timing diagram provided by an embodiment of the present disclosure.

A circuit timing diagram corresponding to the pixel driving circuit shown in FIG. 2 is shown in FIG. 4. Specifically, five phases of a recovery phase T1, a voltage adjustment phase T2, a threshold latch phase T3, a data input phase T4, and a light-emitting phase T5 in the input timing diagram shown in FIG. 4 are selected.

In the recovery phase T1, a voltage of the signal from the first voltage signal terminal VDD is a first preset power supply voltage Vdd1, SCAN1=0, SCAN2=1, SCAN3=0, EM=1.

Since SCAN1=0, the first switch transistor M1 is turned off. Since SCAN3=0, the fourth switch transistor M4 is turned off. Since SCAN2=1, both the second switch transistor M2 and the third switch transistor M3 are turned on. Since EM=1, the fifth switch transistor M5 is turned on. The turned-on fifth switch transistor M5 and the turned-on third switch transistor M3 provide the signal being at the first preset power supply voltage Vdd1 from the first voltage signal terminal VDD to the gate of the driving transistor M0, so that a voltage of the gate of the driving transistor M0 is Vdd1. The turned-on second switch transistor M2 provides the signal being at the first preset voltage V1 from the data signal terminal DATA to the first terminal of the light-emitting device L. In addition, by making the first preset voltage V1 smaller than Vss, the cathode voltage of the light-emitting device L is higher than the anode voltage of the light-emitting device L, so that the light-emitting device L is in a polarity inversion state, and the characteristics of the light-emitting device L are restored. Moreover, in order to turn on the driving transistor M0, the first preset power supply voltage Vdd1 may be greater than the first preset voltage V1.

In the voltage adjustment phase T2, the voltage of the signal from the first voltage signal terminal VDD is the first preset power supply voltage Vdd1, SCAN1=1, SCAN2=0, SCAN3=0, EM=1.

Since SCAN2=0, both the second switch transistor M2 and the third switch transistor M3 are turned off. Since SCAN3=0, the fourth switch transistor M4 is turned off. Since EM=1, the fifth switch transistor M5 is turned on to provide the signal being at the first preset power supply voltage Vdd1 from the first voltage signal terminal VDD to the first electrode of the third switch transistor M3. Since SCAN1=1, the first switch transistor M1 is turned on to provide the signal being at the second preset voltage V2 from the data signal terminal DATA to the gate of the driving transistor M0. According to a coupling effect of the storage capacitor CST, a voltage VB at the second terminal of the storage capacitor CST becomes:

$$VB = V1 - (Vdd1 - V2)\frac{Cs}{Cs + CL};$$

where Cs indicates a capacitance value of the storage capacitor CST, and CL indicates a capacitance value of the light-emitting device L.

In the threshold latch phase T3, a voltage of the signal from the first voltage signal terminal VDD is a second preset power supply voltage Vdd2, SCAN1=1, SCAN2=0, SCAN3=1, EM=1. In addition, the second preset power supply voltage Vdd2 is less than the first preset power supply voltage Vdd1.

Since SCAN2=0, both the second switch transistor M2 and the third switch transistor M3 are turned off. Since SCAN1=1, the first switch transistor M1 is turned on to provide the signal being at the second preset voltage V2 from the data signal terminal DATA to the gate of the driving transistor M0. Since SCAN3=1, the fourth switch transistor M4 is turned on. Since EM=1, the fifth switch transistor M5 is turned on. The turned-on fifth switch transistor M5 and the turned-on fourth switch transistor M4 provide the signal being at the second preset power supply voltage Vdd2 from the first voltage signal terminal VDD to the first electrode of the driving transistor M0. In this way, the anode of the light-emitting device L is charged through the driving transistor M0, the fifth switch transistor M5, and the fourth switch transistor M4, and when the anode of the light-emitting device L is charged to V2-$V_t$h, the driving transistor M0 is turned off. It should be noted that, in order to latch the threshold voltage $V_{th}$ of the driving transistor M0, the following conditions may be satisfied:

$$\left|V2 - \left[V1 - (Vdd - V2)\frac{Cs}{Cs + CL}\right]\right| > |V_{th}|.$$

In the data input phase T4, a voltage of the signal from the first voltage signal terminal VDD is a third preset power supply voltage Vdd3, SCAN1=1, SCAN2=0, SCAN3=1, EM=0. In addition, the third preset power supply voltage Vdd3 is greater than the first preset power supply voltage Vdd1.

Since SCAN2=0, both the second switch transistor M2 and the third switch transistor M3 are turned off. Since EM=0, the fifth switch transistor M5 is turned off. Since SCAN1=1, the first switch transistor M1 is turned on to provide the data voltage V3 of the signal from the data signal terminal DATA to the gate of the driving transistor M0. According to the coupling effect of the storage capacitor CST, the voltage VB at the second terminal of the storage capacitor CST becomes:

$$VB = (V2 - V_{th}) + (V3 - V2)\frac{Cs}{Cs + CL}.$$

In addition, in order to avoid unnecessary light emission of the light-emitting device L during the entire display frame period, the voltage VB at the second terminal of the storage capacitor CST may satisfy the formula: VB-Vss<$V_{th\text{-}L}$.

In the light-emitting phase T5, a voltage of the signal from the first voltage signal terminal VDD is a third preset power supply voltage Vdd3, SCAN1=0, SCAN2=0, SCAN3=1, and EM=1.

Since SCAN1=0, the first switch transistor M1 is turned off. Since SCAN2=0, both the second switch transistor M2 and the third switch transistor M3 are turned off. Since EM=1, the fifth switch transistor M5 is turned on. Since SCAN3=1, the fourth switch transistor M4 is turned on. The turned-on fifth switch transistor M5 and the turned-on fourth switch transistor M4 provide the signal being at the third preset power supply voltage Vdd3 from the first voltage signal terminal VDD to the first electrode of the driving transistor M0. According to the saturation state current characteristics, the driving current $I_L$ generated by the driving transistor M0 for driving the light-emitting device L to emit light satisfies the formula:

$$I_L = \beta(V_{gs} - V_{th})^2 = \beta\left[(V3 - V2)\frac{CL}{Cs + CL}\right]^2,$$

$$\beta = \frac{1}{2}\mu_n C_{ox}\frac{W}{L},$$

$\mu_n$ indicates a mobility of the driving transistor M0, $C_{ox}$ indicates a gate oxide capacitance per unit area, and $$\frac{W}{L}$$

indicates a width-length ratio of the driving transistor M0, these values are relatively stable and may be regarded as constants in same structure.

According to the formula satisfied by the driving current $I_L$, when the driving transistor M0 is in a saturated state, the driving current $I_L$ is related to the second preset voltage V2 and the data voltage V3 at the data signal terminal DATA, and is not related to the threshold voltage $V_{th}$ of the driving transistor M0 and the voltage at the first voltage signal terminal VDD, which may avoid the impact of the drift of the threshold voltage $V_{th}$ of the driving transistor M0 and IR Drop on the driving current, so that the driving current $I_L$ of the light-emitting device L remains stable, thereby ensuring the normal operation of the light-emitting device L.

It should be noted that in a process from the data input phase T4 to the light-emitting phase T5, a time when the signal from the first scan signal terminal SCAN1 transitions from a high level to a low level may be earlier than a time when the signal from the light-emitting control signal terminal EM transitions from a low level to a high level. This may prevent competition and risk and improve the stability of the pixel driving circuit.

It should be noted that in the second embodiment of the present disclosure, the specific values of voltages Vdd1, Vdd2, and Vdd3 of the signal from the first voltage signal terminal VDD may be designed and determined according to the actual application environment, which is not limited here.

It should be noted that the first preset voltage V1 may be less than the second preset voltage V2, and the second preset voltage V2 may be less than or equal to 0V. In actual applications, the specific values of the first preset voltage V1 and the second preset voltage V2 may be designed and determined according to the actual application environment, which is not limited here.

Figure 5:
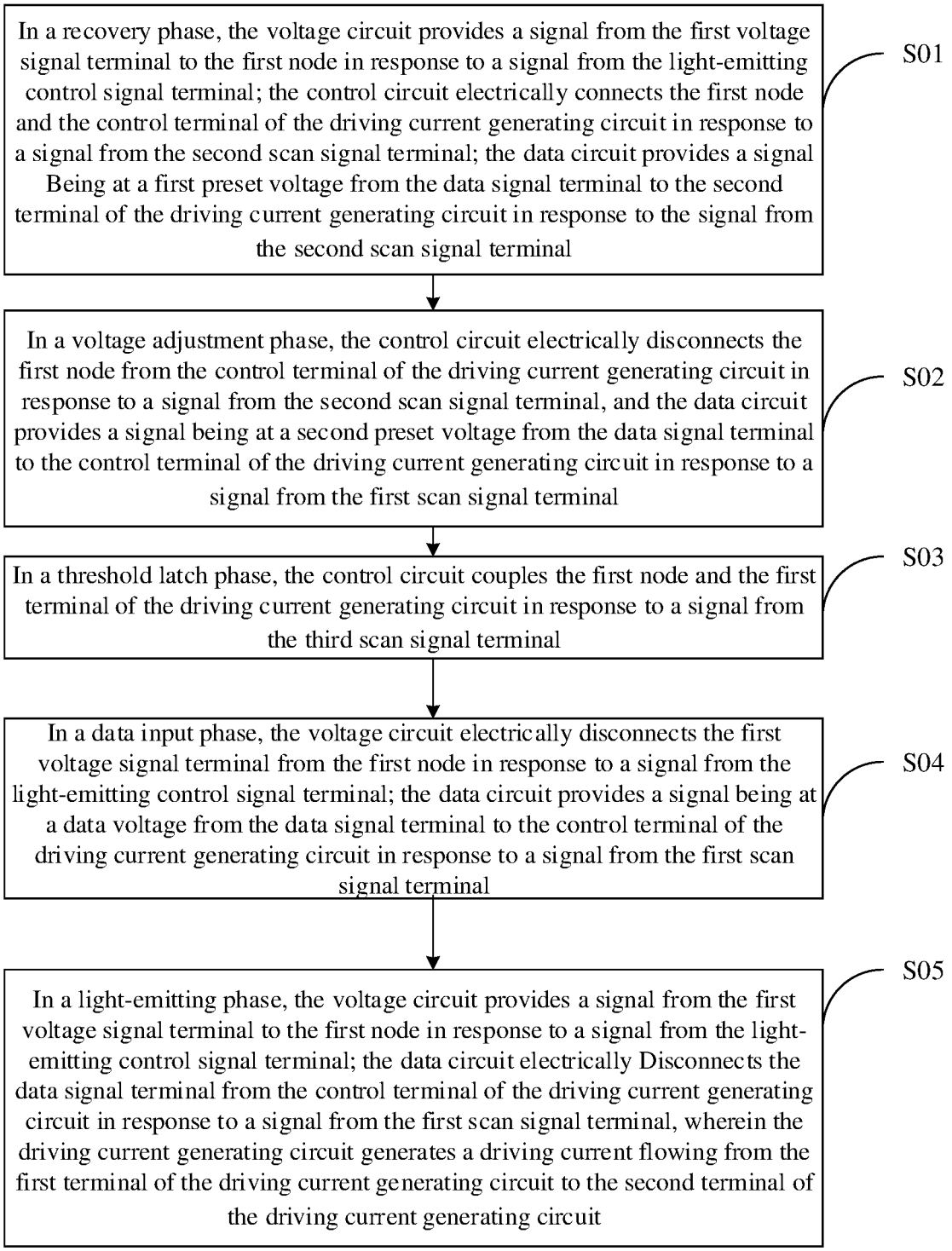
FIG. 5 is a flowchart of a driving method provided by an embodiment of the disclosure.

Based on the same inventive concept, embodiments of the present disclosure also provide a method for driving the above-mentioned pixel driving circuit, as shown in FIG. 5, which may include the following steps.

S01: in a recovery phase, a voltage circuit provides a signal from a first voltage signal terminal to a first node in response to a signal from a light-emitting control signal terminal; a control circuit electrically connects (conducts) the first node and a control terminal (for example, a gate of a driving transistor) of a driving current generating circuit in response to a signal from a second scan signal terminal; a data circuit provides a signal being at a first preset voltage from the data signal terminal to a second terminal of the driving current generating circuit in response to the signal from the second scan signal terminal, thereby providing the signal being at the first preset voltage from the data signal terminal to a first terminal of a light-emitting device.

S02: in a voltage adjustment phase, the control circuit electrically disconnects the first node from the control terminal of the driving current generating circuit in response to the signal from the second scan signal terminal, and the data circuit provides the signal being at the second preset voltage from the data signal terminal to the control terminal (for example, the gate of the driving transistor) of the driving current generating circuit in response to the signal from the first scan signal terminal; where the first preset voltage is less than the second preset voltage, and the second preset voltage is less than or equal to 0V.

S03: in a threshold latch phase, the control circuit conducts the first node and the first electrode of the driving transistor in response to a signal from the third scan signal terminal. During this period, the data circuit may continue to provide a signal being at a second preset voltage from the data signal terminal to a gate of the driving transistor in response to the signal from the first scan signal terminal, and the voltage circuit may continue to provide the signal from the first voltage signal terminal to the first node in response to the signal from the light-emitting control signal terminal.

S04: in a data input phase, the voltage circuit electrically disconnects the first voltage signal terminal from the first node in response to the signal from the light-emitting control signal terminal; the data circuit provides the data voltage of the signal from the data signal terminal to the control terminal (for example, the gate of the driving transistor) of the driving current generating circuit in response to the signal from the first scan signal terminal.

S05: in a light-emitting phase, the voltage circuit provides the signal from the first voltage signal terminal to the first node in response to the signal from the light-emitting control signal terminal; the data circuit electrically disconnects the data signal terminal from the control terminal of the driving current generating circuit in response to the signal from the first scan signal terminal; the driving current generating circuit generates a driving current flowing from the first terminal of the driving current generating circuit to the second terminal of the driving current generating circuit, thereby driving the light-emitting device to emit light. During this period, the control circuit may maintain the electrical connection between the first node and the first electrode of the driving transistor in response to the signal from the third scan signal terminal.

According to an embodiment of the present disclosure, in the recovery phase, the voltage circuit provides the signal being at the first preset power supply voltage from the first voltage signal terminal to the first node in response to the signal from the light-emitting control signal terminal; where the first preset power supply voltage is not equal to the first preset voltage.

In the voltage adjustment phase, the voltage circuit provides the signal being at the first preset power supply voltage from the first voltage signal terminal to the first node in response to the signal from the light-emitting control signal terminal.

According to an embodiment of the present disclosure, in the threshold latch phase, the voltage circuit provides the signal being at the second preset power supply voltage from the first voltage signal terminal to the first node in response to the signal from the light-emitting control signal terminal; the second preset power voltage is less than the first preset power voltage.

According to an embodiment of the present disclosure, in the light-emitting phase, the voltage circuit provides the signal being at the third preset power supply voltage from the first voltage signal terminal to the first node in response to the signal from the light-emitting control signal terminal; where the third preset power supply voltage is greater than the first preset power supply voltage.

Where the driving principle and specific implementation of the method for driving the pixel driving circuit are the same as those of the pixel driving circuit of the foregoing embodiment. Therefore, the method for driving the pixel driving circuit may be implemented with reference to the specific implementation of the pixel driving circuit in the above-mentioned embodiment, and will not be repeated here.

An embodiment of the present disclosure further provides a display panel including any of the above-mentioned pixel driving circuits. The problem-solving principle of the display panel is similar to that of the aforementioned pixel driving circuit. Therefore, the implementation of the display panel may refer to the implementation of the aforementioned pixel driving circuit, and the repetition will not be repeated here.

An embodiment of the present disclosure further provides a display device, including the above-mentioned display panel provided by an embodiment of the present disclosure. The display device may be any product or component with a display function, such as a mobile phone, a tablet computer, a television, a monitor, a notebook computer, a digital photo frame, a navigator, etc. The other indispensable components of the display device are understood by those of ordinary skill in the art, and will not be repeated here, nor should they be used as a limitation to the present disclosure. The implementation of the display device may refer to the embodiment of the above-mentioned display panel, and the repetition is not repeated here.

According to the pixel driving circuit and the driving method thereof, the display panel, and the display device provided by the embodiments of the present disclosure, a data circuit provides a signal from a data signal terminal to a gate of a driving transistor in response to a signal from a first scan signal terminal, and provides the signal from the data signal terminal to a first terminal of an light-emitting device in response to a signal from a second scan signal terminal; a voltage circuit provides a signal from a first voltage signal terminal to a first node in response to a signal from a light-emitting control signal terminal; and a control circuit couples the first node and the gate of the driving transistor in response to a signal from a second scan signal terminal, and couples the first node and the first electrode of the driving transistor in response to a signal from a third scan signal terminal. In this way, a threshold voltage $V_{th}$ of the driving transistor may be compensated through the cooperation of the above-mentioned circuits and the driving current generating circuit (comprising the driving transistor and a storage capacitor), so that a driving current of the driving transistor to drive the light-emitting device to emit light is independent of the threshold voltage of the driving transistor, and an impact of the threshold voltage of the driving transistor on the driving current flowing through the light-emitting device may be avoided. Therefore the driving current may be kept stable, and a brightness uniformity of a display area of the display device may be improved.

Obviously, those skilled in the art may make various modifications and variations to the present disclosure without departing from the spirit and scope of the present disclosure. In this way, if these modifications and variations of the present disclosure fall within the scope of the claims of the present disclosure and their equivalent technologies, the present disclosure is also intended to include these modifications and variations.

What is claimed is:

1. A pixel driving circuit, comprising:

a driving current generating circuit having a control terminal, a first terminal, and a second terminal;

a data circuit configured to provide a signal from a data signal terminal to the control terminal of the driving current generating circuit in response to a signal from a first scan signal terminal, and provide a signal from the data signal terminal to the second terminal of the driving current generating circuit in response to a signal from a second scan signal terminal;

a voltage circuit configured to provide a signal from a first voltage signal terminal to a first node in response to a signal from a light-emitting control signal terminal; and a control circuit configured to electrically connect the first node and the control terminal of the driving current generating circuit in response to a signal from the second scan signal terminal, and electrically connect the first node and the first terminal of the driving current generating circuit in response to a signal from a third scan signal terminal.

2. The pixel driving circuit according to claim 1, wherein the data circuit comprises: a first switch transistor and a second switch transistor;

wherein a gate of the first switch transistor is coupled to the first scan signal terminal, a first electrode of the first switch transistor is coupled to the data signal terminal, and a second electrode of the first switch transistor is coupled to the control terminal of the driving current generating circuit; and a gate of the second switch transistor is coupled to the second scan signal terminal, a first electrode of the second switch transistor is coupled to the data signal terminal, and a second electrode of the second switch transistor is coupled to the second terminal of the driving current generating circuit.

3. The pixel driving circuit according to claim 1, wherein the control circuit comprises: a third switch transistor and a fourth switch transistor;

wherein a gate of the third switch transistor is coupled to the second scan signal terminal, a first electrode of the third switch transistor is coupled to the first node, and a second electrode of the third switch transistor is coupled to the control terminal of the driving current generating circuit; and a gate of the fourth switch transistor is coupled to the third scan signal terminal, a first electrode of the fourth switch transistor is coupled to the first node, and a second electrode of the fourth switch transistor is coupled to the first terminal of the driving current generating circuit.

4. The pixel driving circuit according to claim 1, wherein the voltage circuit comprises: a fifth switch transistor;

wherein a gate of the fifth switch transistor is coupled to the light-emitting control signal terminal, a first electrode of the fifth switch transistor is coupled to the first voltage signal terminal, and a second electrode of the fifth switch transistor is coupled to the first node.

5. The pixel driving circuit according to claim 1, wherein the driving current generating circuit comprises:

a driving transistor, wherein a gate of the driving transistor is used as the control terminal of the driving current generating circuit, a first electrode of the driving transistor is used as the first terminal of the driving current generating circuit, and a second electrode of the driving transistor uses as the second terminal of the driving current generating circuit; and a storage capacitor, wherein a first terminal of the storage capacitor is coupled to the gate of the driving transistor, and a second terminal of the storage capacitor is coupled to the second electrode of the driving transistor.

6. A method for driving the pixel driving circuit according to claim 1, comprising that:

in a recovery phase, the voltage circuit provides a signal from the first voltage signal terminal to the first node in response to a signal from the light-emitting control signal terminal; the control circuit electrically connects the first node and the control terminal of the driving current generating circuit in response to a signal from the second scan signal terminal; the data circuit provides a signal being at a first preset voltage from the data signal terminal to the second terminal of the driving current generating circuit in response to the signal from the second scan signal terminal;

in a voltage adjustment phase, the control circuit electrically disconnects the first node from the control terminal of the driving current generating circuit in response to a signal from the second scan signal terminal, and the data circuit provides a signal being at a second preset voltage from the data signal terminal to the control terminal of the driving current generating circuit in response to a signal from the first scan signal terminal; wherein the first preset voltage is less than the second preset voltage, and the second preset voltage is less than or equal to 0V;

in a threshold latch phase, the control circuit electrically connects the first node and the first terminal of the driving current generating circuit in response to a signal from the third scan signal terminal;

in a data input phase, the voltage circuit electrically disconnects the first voltage signal terminal from the first node in response to a signal from the light-emitting control signal terminal; the data circuit provides a signal being at a data voltage from the data signal terminal to the control terminal of the driving current generating circuit in response to a signal from the first scan signal terminal; and in a light-emitting phase, the voltage circuit provides a signal from the first voltage signal terminal to the first node in response to a signal from the light-emitting control signal terminal; the data circuit electrically disconnect the data signal terminal from the control terminal of the driving current generating circuit in response to a signal from the first scan signal terminal, and the driving current generating circuit generates a driving current flowing from the first terminal of the driving current generating circuit to the second terminal of the driving current generating circuit.

7. The method according to claim 6, wherein:

in the recovery phase, the voltage circuit provides a signal being at a first preset power supply voltage from the first voltage signal terminal to the first node in response to the signal from the light-emitting control signal terminal; wherein the first preset power supply voltage is not equal to the first preset voltage; and in the voltage adjustment phase, the voltage circuit provides the signal being at the first preset power supply voltage from the first voltage signal terminal to the first node in response to the signal from the light-emitting control signal terminal.

8. The method according to claim 7, wherein in the threshold latch phase, the voltage circuit provides a signal being at a second preset power supply voltage from the first voltage signal terminal to the first node in response to the signal from the light-emitting control signal terminal; wherein the second preset power supply voltage is less than the first preset power supply voltage.

9. The method according to claim 7, wherein in the light-emitting phase, the voltage circuit provides a signal being at a third preset power supply voltage from the first voltage signal terminal to the first node in response to the signal from the light-emitting control signal terminal; wherein the third preset power supply voltage is greater than the first preset power supply voltage.

10. The method according to claim 6, wherein in the voltage adjustment phase, the signal being at the second preset voltage from the data signal terminal is provided to the control terminal of the driving current generating circuit after the first node is electrically disconnected from the control terminal of the driving current generating circuit.

11. The method according to claim 6, wherein:

in the light-emitting phase, the signal from the first voltage signal terminal is provided to the first node after the data signal terminal is electrically disconnected from the control terminal of the driving current generating circuit.

12. A display panel comprising the pixel driving circuit according to claim 1.

13. A display device comprising the display panel according to claim 12.

14. A method for driving the pixel driving circuit according to claim 2, comprising that:

in a recovery phase, the voltage circuit provides a signal from the first voltage signal terminal to the first node in response to a signal from the light-emitting control signal terminal; the control circuit electrically connects the first node and the control terminal of the driving current generating circuit in response to a signal from the second scan signal terminal; the data circuit provides a signal being at a first preset voltage from the data signal terminal to the second terminal of the driving current generating circuit in response to the signal from the second scan signal terminal;

in a voltage adjustment phase, the control circuit electrically disconnects the first node from the control terminal of the driving current generating circuit in response to a signal from the second scan signal terminal, and the data circuit provides a signal being at a second preset voltage from the data signal terminal to the control terminal of the driving current generating circuit in response to a signal from the first scan signal terminal; wherein the first preset voltage is less than the second preset voltage, and the second preset voltage is less than or equal to 0V;

in a threshold latch phase, the control circuit electrically connects the first node and the first terminal of the driving current generating circuit in response to a signal from the third scan signal terminal;

in a data input phase, the voltage circuit electrically disconnects the first voltage signal terminal from the first node in response to a signal from the light-emitting control signal terminal; the data circuit provides a signal being at a data voltage from the data signal terminal to the control terminal of the driving current generating circuit in response to a signal from the first scan signal terminal; and in a light-emitting phase, the voltage circuit provides a signal from the first voltage signal terminal to the first node in response to a signal from the light-emitting control signal terminal; the data circuit electrically disconnect the data signal terminal from the control terminal of the driving current generating circuit in response to a signal from the first scan signal terminal, and the driving current generating circuit generates a driving current flowing from the first terminal of the driving current generating circuit to the second terminal of the driving current generating circuit.

15. The method according to claim 14, wherein:

in the recovery phase, the voltage circuit provides a signal being at a first preset power supply voltage from the first voltage signal terminal to the first node in response to the signal from the light-emitting control signal terminal; wherein the first preset power supply voltage is not equal to the first preset voltage; and in the voltage adjustment phase, the voltage circuit provides the signal being at the first preset power supply voltage from the first voltage signal terminal to the first node in response to the signal from the light-emitting control signal terminal.

16. A method for driving the pixel driving circuit according to claim 3, comprising that:

in a recovery phase, the voltage circuit provides a signal from the first voltage signal terminal to the first node in response to a signal from the light-emitting control signal terminal; the control circuit electrically connects the first node and the control terminal of the driving current generating circuit in response to a signal from the second scan signal terminal; the data circuit provides a signal being at a first preset voltage from the data signal terminal to the second terminal of the driving current generating circuit in response to the signal from the second scan signal terminal;

in a voltage adjustment phase, the control circuit electrically disconnects the first node from the control terminal of the driving current generating circuit in response to a signal from the second scan signal terminal, and the data circuit provides a signal being at a second preset voltage from the data signal terminal to the control terminal of the driving current generating circuit in response to a signal from the first scan signal terminal; wherein the first preset voltage is less than the second preset voltage, and the second preset voltage is less than or equal to 0V;

in a threshold latch phase, the control circuit electrically connects the first node and the first terminal of the driving current generating circuit in response to a signal from the third scan signal terminal;

in a data input phase, the voltage circuit electrically disconnects the first voltage signal terminal from the first node in response to a signal from the light-emitting control signal terminal; the data circuit provides a signal being at a data voltage from the data signal terminal to the control terminal of the driving current generating circuit in response to a signal from the first scan signal terminal; and in a light-emitting phase, the voltage circuit provides a signal from the first voltage signal terminal to the first node in response to a signal from the light-emitting control signal terminal; the data circuit electrically disconnect the data signal terminal from the control terminal of the driving current generating circuit in response to a signal from the first scan signal terminal, and the driving current generating circuit generates a driving current flowing from the first terminal of the driving current generating circuit to the second terminal of the driving current generating circuit.

17. A display panel comprising the pixel driving circuit according to claim 2.

18. A display panel comprising the pixel driving circuit according to claim 3.

19. A display device comprising the display panel according to claim 17.

20. A display device comprising the display panel according to claim 18.

* * * * *